US005896117A

United States Patent [19]

Moon

[11] Patent Number: 5,896,117

[45] Date of Patent: Apr. 20, 1999

[54] DRIVE CIRCUIT WITH REDUCED KICKBACK VOLTAGE FOR LIQUID CRYSTAL DISPLAY

[75] Inventor: Seung-Hwan Moon, Seoul, Rep. of Korea

[73] Assignee: Samsung Electronics, Co., Ltd., Suwon, Rep. of Korea

[21] Appl. No.: 08/671,414

[22] Filed: Jun. 27, 1996

[30] Foreign Application Priority Data

Sep. 29, 1995 [KR] Rep. of Korea ..... 95-33018

[51] Int. Cl.[6] ..... G09G 3/36

[52] U.S. Cl. ..... 345/95; 345/92; 345/211

[58] Field of Search ..... 345/87, 91, 92, 345/94, 95, 204, 208, 210, 211, 212, 101; 349/41, 50, 43; 327/530

[56] References Cited

U.S. PATENT DOCUMENTS 5,323,171 6/1994 Yokouchi et al. ..... 345/211

5,635,865 6/1997 Moon et al. ..... 345/211

*Primary Examiner*—Lun-Yi Lao

*Attorney, Agent, or Firm*—Marger Johnson & McCollom P.C.

[57] ABSTRACT

A drive circuit and method for driving a thin film transistor liquid crystal display which reduce kickback voltage by generating a gate drive signal that has a reduced on voltage during a drop portion of the horizontal scanning time. The circuit includes a voltage signal generating circuit for receiving both a common electrode signal and an inverting common electrode signal and generating voltage signals, a drop signal generating circuit for generating drop signals, and a signal mixer circuit for combining the voltage signals and the drop signals and generating a composite output signal. The voltage signal generating circuit and the drop signal generating circuits both include a series of boost stages comprised of diode voltage multipliers. The signal mixing circuit includes a series of switches that are controlled by the drop signals. The length of the drop portion of the horizontal scan time can be controlled by a period control signal.

17 Claims, 5 Drawing Sheets

DRIVE CIRCUIT WITH REDUCED KICKBACK VOLTAGE FOR LIQUID CRYSTAL DISPLAY

BACKGROUND OF THE INVENTION

1. Field of the Invention

The present invention relates to drive circuits for liquid crystal displays, and more particularly, to drive circuits that reduce kickback voltage and power consumption.

2. Description of the Related Art

Liquid crystal displays (LCD's) have grown increasingly popular as substitutes for cathode ray tubes in electronic appliances. LCD's can be driven by large scale integrated circuits because of their low-voltage and low-power consumption characteristics. Accordingly, LCDs have been widely produced on a commercial scale for use in laptop computers, pocket computers, automobiles, color televisions, etc.

Thin film transistor liquid crystal displays (TFT-LCDs) typically use twisted nematic (TN) crystals and have a transistor and a storage capacitor associated with each pixel. The transistor and capacitor are made of a thin film, such as amorphous silicon on a glass substrate. A pixel in a TFT-LCD can only be turned on by applying a gate signal to the transistor associated with the pixel. A display that uses transistors to turn pixels on and off is referred to as an active display.

FIG. 1 shows a schematic diagram of a typical TFT-LCD array. Each pixel circuit, or cell, includes a switching transistor, a liquid crystal, and a storage capacitor. Matrix addressing is provided by data lines which connect the source terminals of transistors in each column of cells, and gate lines which connect the gates of transistors in each row of cells. The liquid crystal in each cell is connected between the drain terminal of the transistor and a common electrode, and the storage capacitor is connected between the drain terminal of the transistor and the gate line of the previous row. A pixel is selected by activating a data line and applying a gate signal to a gate line. Since transistors can be selected individually in a TFT-LCD, there is no cross talk between pixels. The storage capacitor stores an electric charge so that the state of the pixel is maintained during a non-selected period.

Referring to FIG. 1, when switching transistors TFT1 and TFT2 are turned on, capacitors Cst1 and Cst2 receive a charge and liquid crystals Clc1 and Clc2 display a grey level based on the voltage level applied to the source terminals of transistors TFT1 and TFT2 through the data line. When the transistors are turned off, the capacitors maintain the voltage level on crystals Clc1 and Clc2, which also have some parasitic capacitance. As long as the leakage current through the crystals is not excessive, the grey level of the crystals is maintained until the pixel is refreshed during the next frame update.

The voltage versus current characteristic of switching transistors TFT1 and TFT2 is shown in FIG. 2.

LCD cells typically require a net DC bias of zero volts to avoid electrochemical degradation. A common method for minimizing the net DC voltage is to apply an AC square wave, typically having a magnitude of 5 volts, to the common electrode terminal, or backplane. The gates of the transistors are then driven with a gate signal having a gate drive signal superimposed on a square wave as is shown in FIGS. 3A and 3B. The square wave portion of the gate signal indicated by Voff1 and Voff2 is the off time. Because the gate signal is in phase with the square wave signal on the common electrode terminal, no voltage is applied to the gate of the switching transistors during the off time. The portion of the gate signal indicated by Von1 and Von2 are applied to the gates lines at intervals of one frame and drive the switching transistors with grey level voltages.

A major problem with this technique is that a high kickback voltage is generated due to the parasitic capacitance Cgs in the switching transistors. When the gate signal changes from Von to Voff, the electric charge in the liquid crystals Clc1 and Clc2 or the capacitors Cst1 and Cst2 is partially transferred to the parasitic capacitance Cgs. As a result, a drop in the grey level voltage is produced. This drop in the grey level voltage is called as the kickback voltage Vk and is given by:

$$Vk=Cgs(Von-Voff)/(Cgs+Clc+Cst) \quad \text{Eq(1)}$$

If the kickback voltage Vk has a high value, the kickback voltage is applied to the TFT-LCD, thereby increasing power consumption and causing poor images due to flickering, stitching, etc.

Accordingly, a need remains for a drive circuit for a liquid crystal display that overcomes the problems described above.

SUMMARY OF THE INVENTION

It is, therefore, an object of the invention to reduce the kickback voltage when driving a liquid crystal display.

One aspect of the present invention is a drive circuit that includes a voltage signal generating means for boosting a supply voltage signal to generate a voltage signal during a scanning time, drop signal generating means for modifying the voltage signal during a portion of the scanning time to generate a drop signal, and signal mixing means for combining the voltage signal and the drop signal to generate a composite signal.

The voltage signal generating means can include a boost stage for receiving the supply voltage signal and generating the voltage signal responsive to an inverting common electrode signal. The boost stage includes a diode and a capacitor, the anode of the diode coupled to the supply voltage signal, one terminal of the capacitor coupled to the cathode of the diode, the other terminal of the capacitor coupled to the inverting common electrode signal.

The drop signal generating means can include a drop signal generator for receiving the voltage signal and generating a drop signal responsive to a control signal. The drop signal generator includes a diode and a capacitor, the anode of the diode coupled to the voltage signal, one terminal of the capacitor coupled to the cathode of the diode, the other terminal of the capacitor coupled to the control signal.

The signal mixing means can include a switch for receiving the voltage signal and generating the composite signal responsive to the drop signal. The switch includes a transistor having a source terminal coupled to the voltage signal and a gate terminal coupled to the drop signal.

Another aspect of the present invention is a method for driving an active liquid crystal display including the steps of generating a composite signal having a voltage during the drop portion of the scanning time that is lower than the voltage during the first portion and applying the composite signal to the display.

The step of generating a composite signal can include the steps off: generating a voltage signal having a scanning time; modifying the voltage signal during a portion of the scanning time to generate a drop signal; and combining the voltage signal and the drop signal to generate a composite signal.

The foregoing and other objects, features and advantages of the invention will become more readily apparent from the following detailed description of a preferred embodiment of the invention which proceeds with reference to the accompanying drawings.

DETAILED DESCRIPTION

This application corresponds to Korean Patent application No. 95-33018, filed Sep. 29, 1995 in the name of Samsung Electronics Co., Ltd., which is hereby incorporated by reference.

Figure 4:
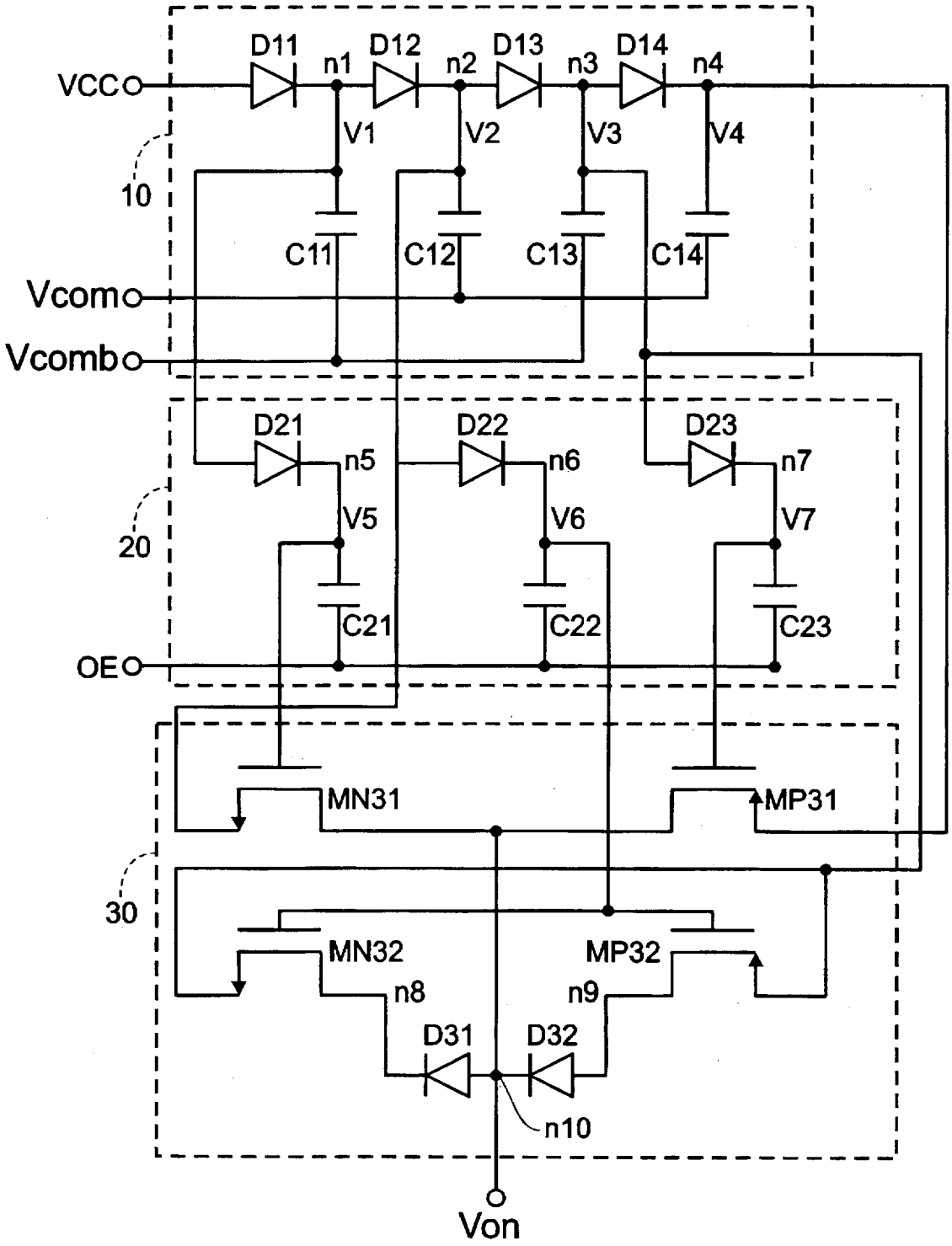
FIG. 4 is a schematic diagram of a drive circuit in accordance with the present invention.

FIG. 4. is a schematic diagram of an embodiment of an LCD drive circuit in accordance with the present invention. Prior to describing the detailed structure of the circuit, the key components of the invention will be identified, and the operation of the system will be briefly explained. Then a more detailed description of each of the components will be provided along with a more detailed description of the operation.

Figure 3A:
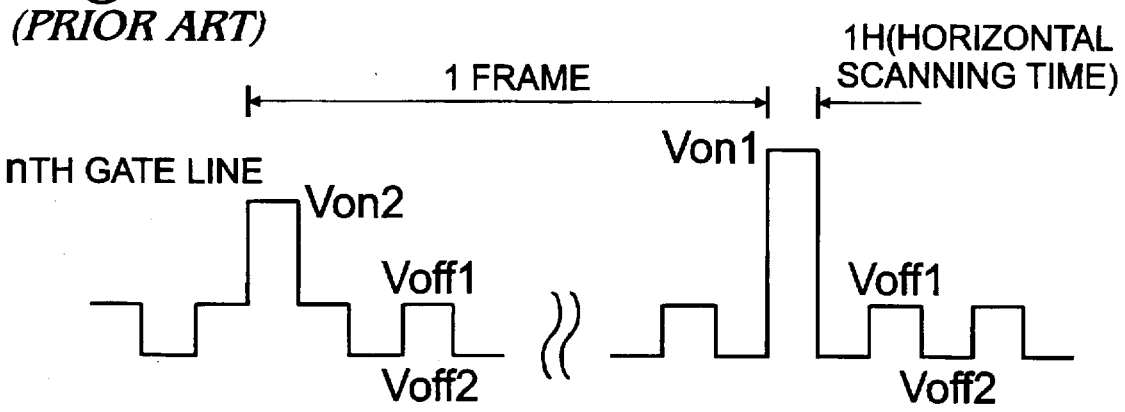
Fig. 3A (PRIOR ART)
FIGS. 3A and 3B show prior art waveforms of drive signals applied to the gate lines of the TFT-LCD of FIG. 1.
Figure 3B:
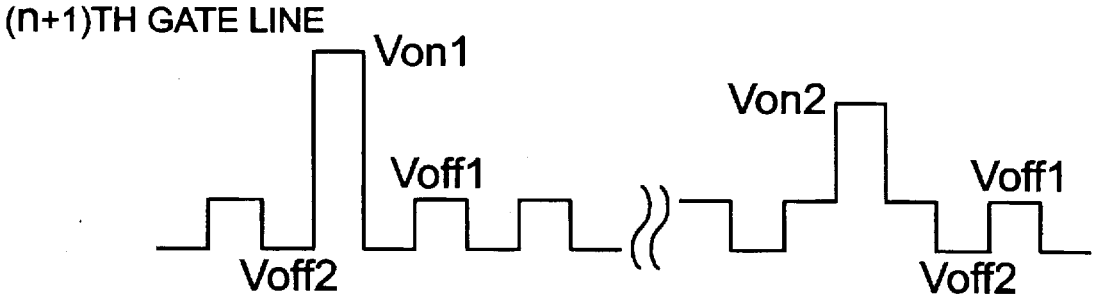
Fig. 3B (PRIOR ART)
Figure 9:
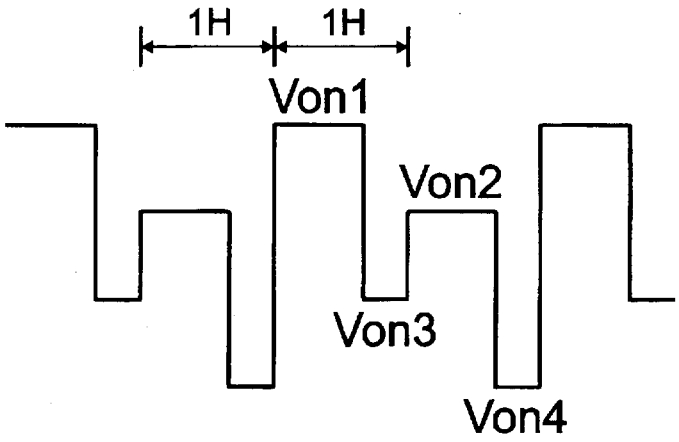
FIG. 9 shows a waveform of a composite output signal generated by the circuit of FIG. 4.
Figure 10:
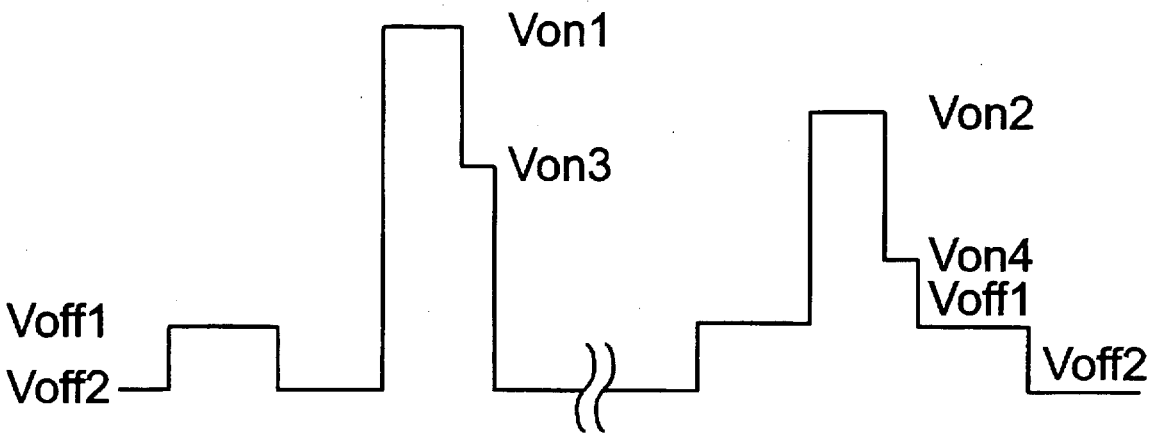
FIG. 10 shows a waveform of gate drive signal generated from the output signal of FIG. 9.

Indicated at 10 in FIG. 4 is a voltage signal generating circuit comprised of a series of cascaded boost stages. Each boost stage generates a voltage signal of successively higher voltage as shown in FIGS. 6A to 6D. A drop signal generating circuit 20 receives the voltage signals and uses them to generate a series of drop signals as shown in FIGS. 7A to 7C. A signal mixing signal 30 receives voltage signals and the drop signals and combines them using a series of switches to generate a composite output signal as shown in FIG. 9. The composite output signal can then be used to generate a gate drive signal as shown in FIG. 10. The gate drive signal shown in FIG. 10 is an improvement over the prior signal shown in FIG. 3B because, during a portion of the on time (horizontal scanning time), the voltage is reduced from Von1 to Von3. This reduces the kickback voltage which improves the performance of the drive circuit. Likewise, during a second on time, the voltage is reduced from Von2 to Von4.

More detailed consideration will now be given to the structure of the present invention. The voltage signal generating circuit 10 includes:

a first diode D11 of which the anode is connected to a supply voltage terminal;

a second diode D12 of which the anode is connected to the cathode of the first diode D11;

a third diode D13 of which the anode is connected to the cathode of the second diode D12;

a fourth diode D14 of which the anode is connected to the cathode of the third diode D13;

a first capacitor C11 of which one terminal is connected to the cathode of the first diode D11 to form a node n1, and of which the other terminal is connected to an inverting common electrode terminal;

a second capacitor C12 of which one terminal is connected to the cathode of the second diode D12 to form a node n2, and of which the other terminal is connected to a common electrode terminal;

a third capacitor C13 of which one terminal is connected to the cathode of the third diode D13 to form a node n3, and of which the other terminal is connected to the inverting common electrode terminal;

a fourth capacitor C14 of which one terminal is connected to the cathode of the fourth diode D14 to form a node n4, and of which the other terminal is connected to the common electrode terminal. Nodes n1–n4 form output terminals for coupling the voltage signals to the drop signal generating circuit.

The drop signal generating circuit 20 includes:

a first diode D21 of which the anode is connected to the cathode of the first diode D11 of the voltage signal generating circuit 10;

a second diode D22 of which the anode is connected to the cathode of the second diode D12 of the voltage signal generating circuit 10;

a third diode D23 of which the anode is connected to the cathode of the third diode D13 of the voltage signal generating circuit 10;

a first capacitor C21 of which one terminal is connected to the cathode of the first diode D21 to form a node n5, and of which the other terminal is connected to a control terminal;

a second capacitor C22 of which one terminal is connected to the cathode of the first diode D22 to form a node n6, and of which the other terminal is connected to the control terminal; and a third capacitor C23 of which one terminal is connected to the cathode of the third diode D23 to form a node n7, and of which the other terminal is connected to the control terminal. The nodes n5–n7 form output terminals for coupling the drop signals to the signal mixing circuit 30.

The signal mixing circuit 30 includes:

a first N-type metal oxide semiconductor transistor (hereinafter referred to as an NMOS transistor) MN 31 of which the source terminal is connected to the cathode of the second diode D12 of the voltage signal generating circuit 10, and of which the gate terminal is connected to the cathode of the first diode D21 of the drop signal generating circuit 20;

a first P-type metal oxide semiconductor transistor (hereinafter referred to as a PMOS transistor) MP 31 of which the source terminal is connected to the cathode of the fourth diode D14 of the voltage signal generating circuit 10, of which the gate terminal is connected to the cathode of the third diode D23 of the drop signal generating circuit 20, and of which the drain terminal is connected to a drain terminal of the first NMOS transistor MN31;

a second NMOS transistor MN32 of which the source terminal is connected to the cathode of the third diode D13 of the voltage signal generating circuit 10, and of which the gate terminal is connected to the cathode of the second diode D22 of the drop signal generating circuit 20;

a second PMOS transistor MP32 of which the source terminal is connected to the cathode of the third diode D13 of the voltage signal generating circuit 10, and of which the gate terminal is connected to the cathode of the second diode D22 of the drop signal generating circuit 20;

a first diode D31 of which the anode is connected to the drain terminal of the first NMOS transistor MN31, and of which the cathode is connected to the drain terminal of the second NMOS transistor MN32; and a second diode D32 of which the anode is connected to the drain terminal of the second PMOS transistor MP32, and of which the cathode is connected to the drain terminal of the first PMOS transistor MP31.

Figure 5A:
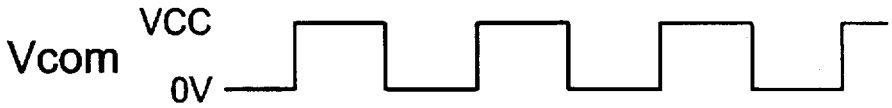
FIGS. 5A to 5C show waveforms of input signals for the drive circuit of FIG. 4.
Figure 5B:
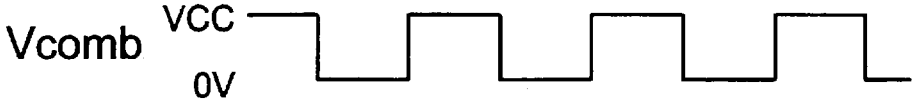

More detailed consideration will now be given to the operation of the present invention. The supply voltage signal VCC, typically 5 volts, is applied to the supply voltage terminal of the voltage signal generating circuit 10. The common electrode signal Vcom, shown in FIG. 5A, and the inverting common electrode signal Vcomb, shown in FIG. 5B are applied to the common electrode terminal and the inverting common electrode terminals, respectively. Both Vcom and Vcomb have constant period equal to twice the horizontal scanning period and are 180 degrees out of phase with each other. Each diode-capacitor pair forms a boost stage that multiplies the signal from the previous stage. The voltage signal generating circuit 10 thereby generates a series of interleaved voltage signals at nodes n1–n4 as shown in FIGS. 6A to 6D.

Figure 6A:
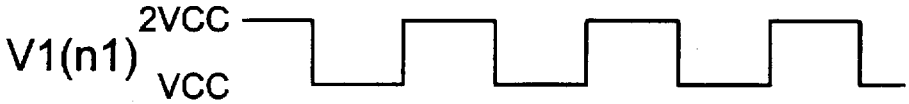
FIGS. 6A to 6D show waveforms of voltage signals generated by the circuit of FIG. 4.
Figure 6B:
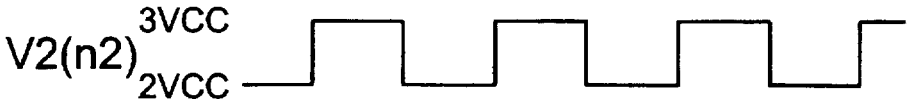
Figure 6C:
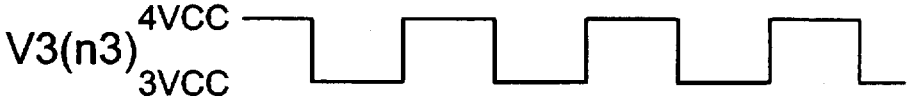
Figure 6D:
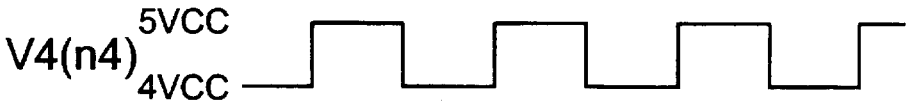
Figure 7A:
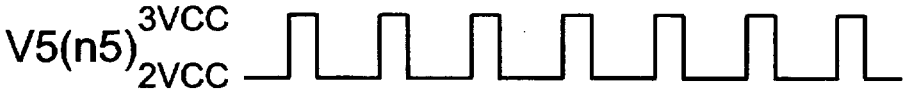
FIGS. 7A to 7C show waveforms of drop signals generated by the circuit of FIG. 4.
Figure 7B:
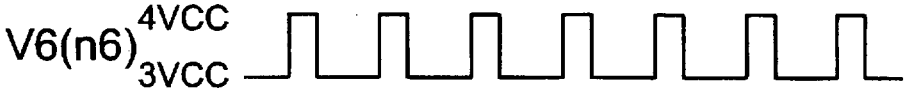
Figure 7C:
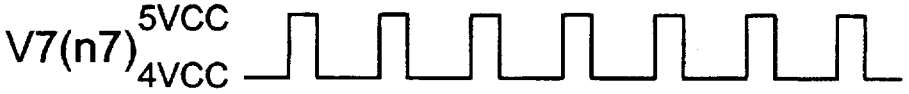

More specifically, in the cathode of the first diode D11, as shown in FIG. 6A, a signal level of the inverting common electrode voltage Vcomb is boosted as much as the supply voltage Vcc. In the cathode of the second diode D12, as shown in FIG. 6B, the common electrode voltage Vcom is raised to twice as much as the supply voltage Vcc. Similarly, in the cathode of the third diode D13, as shown in FIG. 6C, the signal level of the inverting common electrode voltage Vcomb is boosted to three times as much as the supply voltage Vcc. In the cathode of the fourth diode D14, as shown in FIG. 6D, the signal level of the common electrode voltage Vcom is boosted to four times as much as the supply voltage Vcc.

Figure 5C:
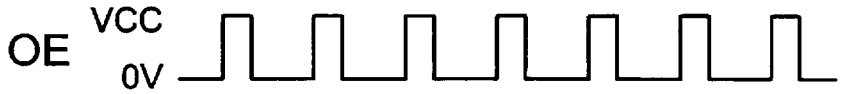

The drop signal generating circuit 20 receives the voltage signals, and using the period control signal OE, shown in FIG. 5C, which is applied to the control terminal, generates a series of drop signals at nodes n5–n7 as shown in FIGS. 7A to 7C. The period control signal OE has a constant period that is half the period of Vcom and Vcomb and a high time that is approximately 10 percent to 20 percent of the low time, and thus the high times of the signals shown in FIGS. 7A to 7C are also approximately 10 percent to 20 percent of the low times.

More specifically, the cathode of the first diode D21 of the drop signal generating circuit 20 raises the voltage signal of the cathode of the second diode D11 of the voltage generating circuit 10, as much as the supply voltage Vcc as shown in FIG. 7A. The cathode of the second diode D22 of the drop signal generating circuit 20 raises the voltage signal of the cathode of the second diode D12 of the voltage generating circuit 10, as much as the supply voltage Vcc as shown in FIG. 7B. The cathode of the third diode D23 of the drop signal generating circuit 20 raises the voltage signal of the cathode of the third diode D13 of the voltage generating circuit 10, as much as the supply voltage Vcc as shown in FIG. 7C.

The signal mixing circuit 30 receives the voltage signals from the voltage signal generating circuit 10 and the drop signal generating circuit 20, mixes the signals, and generates a composite signal as shown in FIG. 9. The drop signals control the gates of MOS transistors MN31, MN32, MP31, and MP32 which are successively and periodically turned on or off at a frequency determined by OE.

First, when the first PMOS transistor MP31 is turned on, the voltage signal at the cathode of the fourth diode D14, which is five times higher than the original supply voltage value, becomes a first on-voltage Von1.

Then, when the second NMOS transistor MN32 is turned on, the voltage signal at the cathode of the third diode D13, which is three times higher than the original supply voltage value, becomes a third on-voltage Von3.

Next, when the second PMOS transistor MP32 is turned on, the voltage signal at the cathode of the third diode D13, which is four times higher than the original supply voltage value, becomes a second on-voltage Von2.

Then, when the first NMOS transistor MN31 is turned on, the voltage signal at the cathode of the second diode D12, which is twice as high as the original supply voltage value, becomes a fourth on-voltage Von4.

Figure 8:
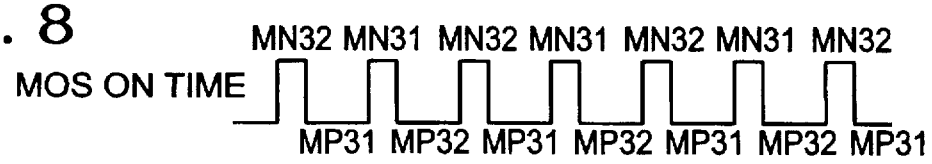
FIG. 8 is a diagram showing on times for switches in the circuit of FIG. 4.

FIG. 8 shows diagrammatically the on times and sequences for the four transistors MN31, MN32, MP31, and MP32.

The four on voltages are thus synthesized to form a composite output signal as shown in FIG. 9. A first horizontal scanning time having a duration of 1 H has a first portion in which the voltage is Von 1 and a drop portion in which the voltage is Von 3. The drop portion is typically 10 to 20 percent of 1 H and can be controlled by controlling the on time of the control signal OE. Likewise, a second horizontal scanning time having a duration of 1 H has a first portion in which the voltage is Von2 and a drop portion in which the voltage is Von 4. The drop portion can also be controlled by controlling the on time of the control signal OE.

Figure 1:
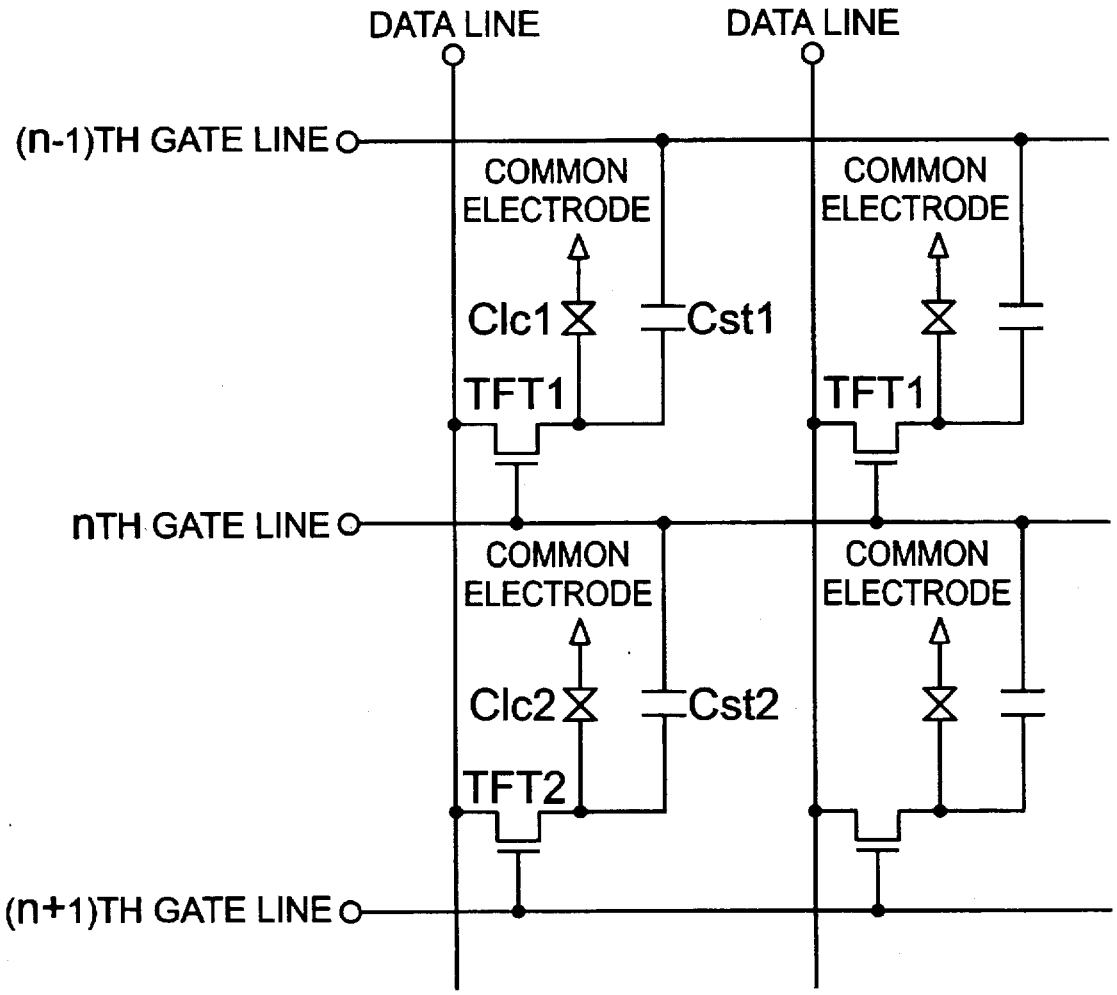
Fig. 1 (PRIOR ART)
FIG. 1 is a schematic diagram showing a prior art array of pixel circuits for a TFT-LCD.
Figure 2:
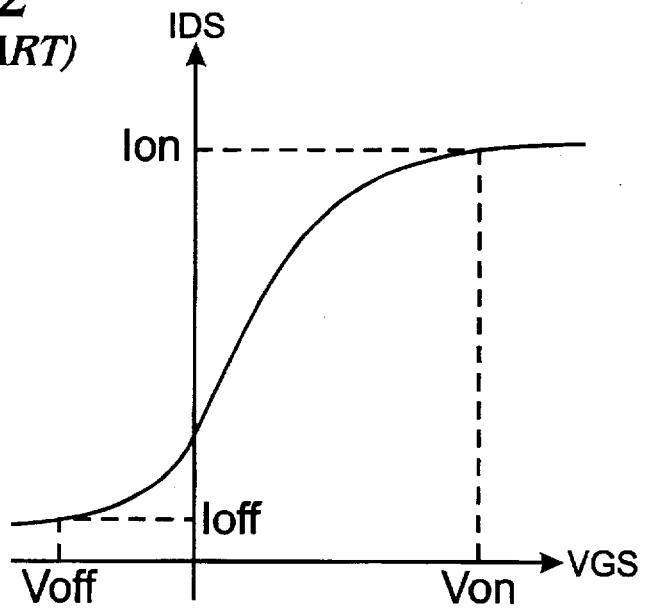
Fig. 2 (PRIOR ART)
FIG. 2 is a graph showing the voltage-to-current characteristic for a typical switching transistor in a prior art TFT-LCD.

The composite output signal can then be used to generate a gate drive signal as shown in FIG. 10. This signal can be used to drive a gate line as shown in FIG. 1. The values of Von1 and Von2 are chosen to be adequate to turn on a switching transistor to provide an appropriate grey level, while Voff1 and Voff2 are chosen to correspond to the voltage applied to the common electrode to turn the transistor off. Thus, when the switching transistor is turned on or off the voltage variation quantity caught in the parasitic capacitance in Eq(1) is reduced as much as Von1–Von3 or Von2–Von4, thereby reducing the kickback voltage which in turn reduces power consumption and improves image quality.

Furthermore, by controlling the high time of the period control signal OE, the kickback voltage while the transistor is turned off is easily controlled.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A drive circuit for an active liquid crystal display comprising:

voltage signal generating means for boosting a supply voltage signal to generate a voltage signal during a scanning time;

drop signal generating means for modifying the voltage signal during a portion of the scanning time to generate a drop signal; and signal mixing means for combining the voltage signal and the drop signal to generate a composite signal.

2. A drive circuit according to claim 1 wherein the drop signal generating means includes a drop signal generator for receiving the voltage signal and generating a drop signal responsive to a control signal.

3. A drive circuit according to claim 1 wherein the signal mixing means includes a switch for receiving the voltage signal and generating the composite signal responsive to the drop signal.

4. A drive circuit according to claim 3 wherein the switch includes a transistor having a source terminal coupled to the voltage signal and a gate terminal coupled to the drop signal.

5. A drive circuit for an active liquid crystal display comprising:

voltage signal generating means for boosting a supply voltage signal to generate a voltage signal during a scanning time;

drop signal generating means for modifying the voltage signal during a portion of the scanning time to generate a drop signal; and signal mixing means for combining the voltage signal and the drop signal to generate a composite signal;

wherein the voltage signal generating means includes a boost stage for receiving the supply voltage signal and generating the voltage signal responsive to an inverting common electrode signal.

6. A drive circuit according to claim 5 wherein the boost stage includes a diode and a capacitor, the anode of the diode coupled to the supply voltage signal, one terminal of the capacitor coupled to the cathode of the diode, the other terminal of the capacitor coupled to the inverting common electrode signal.

7. A drive circuit according to claim 5 wherein the voltage signal generating means further includes:

a second boost stage for receiving the voltage signal and generating a second voltage signal responsive to a common electrode signal;

a third boost stage for receiving the second voltage signal and generating a third voltage signal responsive to the inverting common electrode signal; and a fourth boost stage for receiving the third voltage signal and generating a fourth voltage signal responsive to the common electrode signal.

8. A drive circuit according to claim 7 wherein:

the boost stage includes a diode and a capacitor, the anode of the diode coupled to the supply voltage signal, one terminal of the capacitor coupled to the cathode of the diode, the other terminal of the capacitor coupled to the inverting common electrode signal;

the second boost stage includes a second diode and a second capacitor, the anode of the second diode coupled to the voltage signal, one terminal of the second capacitor coupled to the cathode of the second diode, the other terminal of the second capacitor coupled to the common electrode signal;

the third boost stage includes a third diode and a third capacitor, the anode of the third diode coupled to the second voltage signal, one terminal of the third capacitor coupled to the cathode of the third diode, the other terminal of the third capacitor coupled to the inverting common electrode signal; and the fourth boost stage includes a fourth diode and a fourth capacitor, the anode of the fourth diode coupled to the third voltage signal, one terminal of the fourth capacitor coupled to the cathode of the fourth diode, the other terminal of the fourth capacitor coupled to the common electrode signal.

9. A drive circuit for an active liquid crystal display comprising:

voltage signal generating means for boosting a supply voltage signal to generate a first voltage signal during a scanning time;

drop signal generating means for modifying the first voltage signal during a portion of the scanning time to generate a drop signal; and signal mixing means for combining the first voltage signal and the drop signal to generate a composite signal;

wherein the drop signal generating means includes a drop signal generator for receiving the first voltage signal and generating a drop signal responsive to a control signal; and wherein the drop signal generator includes a diode and a capacitor, the anode of the diode coupled to the first voltage signal, one terminal of the capacitor coupled to the cathode of the diode, the other terminal of the capacitor coupled to the control signal.

10. A drive circuit according to claim 9 wherein the drop signal generating means further includes:

a second drop signal generator for receiving the second voltage signal and generating a second drop signal responsive to the control signal, the second drop signal generator including a second diode and a second capacitor, the anode of the second diode coupled to the second voltage signal, one terminal of the second capacitor coupled to the cathode of the second diode, the other terminal of the second capacitor coupled to the control signal; and a third drop signal generator for receiving the third voltage signal and generating a third drop signal responsive to the control signal, the third drop signal generator including a third diode and a third capacitor, the anode of the third diode coupled to the third voltage signal, one terminal of the third capacitor coupled to the cathode of the third diode, the other terminal of the third capacitor coupled to the control signal.

11. A drive circuit for an active liquid crystal display comprising:

voltage signal generating means for boosting a supply voltage signal to generate a first voltage signal during a scanning time;

drop signal generating means for modifying the first voltage signal during a portion of the scanning time to generate a drop signal; and signal mixing means for combining the first voltage signal and the drop signal to generate a composite signal;

wherein the voltage signal generating means generates second, third and fourth voltage signals, the drop signal generating means generates first, second and third drop signals, and the signal mixing means includes:

a first switch for receiving the second voltage signal and generating a first portion of the composite signal responsive to the first drop signal;

a second switch for receiving the third voltage signal and generating a second portion of the composite signal responsive to the second drop signal;

a third switch for receiving the third voltage signal and generating a third portion of the composite signal responsive to the second drop signal; and a fourth switch for receiving the fourth voltage signal and generating a fourth portion of the composite signal responsive to the third drop signal.

12. A drive circuit according to claim 11 wherein:

the first switch includes a transistor having a source terminal coupled to the second voltage signal and a gate terminal coupled to the first drop signal;

the second switch includes a transistor having a source terminal coupled to the third voltage signal and a gate terminal coupled to the second drop signal;

the third switch includes a transistor having a source terminal coupled to the third voltage signal and a gate terminal coupled to the second drop signal;

the fourth switch includes a transistor having a source terminal coupled to the fourth voltage signal and a gate terminal coupled to the third drop signal.

13. A drive circuit according to claim 11 further including a first diode having a cathode coupled to the second switch and a second diode having an anode coupled to the third switch, the anode of the first diode coupled to the cathode of the second diode.

14. A drive circuit for an active liquid crystal display comprising:

a voltage generating circuit having a supply terminal for receiving a supply signal, and a plurality of output terminals, the voltage generating circuit generating voltage signals at its output terminals;

a drop signal generating circuit having a plurality of input terminals coupled to the output terminals of the voltage generating circuit to receive the voltage signals, and a plurality of output terminals, the drop signal generating circuit modifying the voltage signals during a portion of a scanning time, thereby generating drop signals at its output terminals; and a signal mixing circuit having a plurality of source input terminals coupled to the output terminals of the voltage generating circuit to receive the voltage signals, a plurality of gate input terminals coupled to the output terminals of the drop signal generating circuit to receive the drop signals, and an output terminal, the signal mixing circuit generating a composite signal at its output terminal.

15. A drive circuit for an active liquid crystal display comprising:

a voltage generating circuit having a supply terminal for receiving a supply signal, and a plurality of output terminals, the voltage generating circuit generating voltage signals at its output terminals;

a drop signal generating circuit having a plurality of input terminals coupled to the output terminals of the voltage generating circuit to receive the voltage signals, and a plurality of output terminals, the drop signal generating circuit generating drop signals at its output terminals; and a signal mixing circuit having a plurality of source input terminals coupled to the output terminals of the voltage generating circuit to receive the voltage signals, a plurality of gate input terminals coupled to the output terminals of the drop signal generating circuit to receive the drop signals, and an output terminal, the signal mixing circuit generating a composite signal at its output terminal;

wherein the voltage generating circuit further includes:

an electrode terminal for receiving an electrode signal;

an inverting electrode terminal for receiving an inverting electrode signal;

a first diode having an anode coupled to the supply terminal and a cathode coupled to a first output terminal;

a second diode having an anode coupled to the first output terminal and a cathode coupled to a second voltage output terminal;

a third diode having an anode coupled to the second output terminal and a cathode coupled to a third output terminal;

a fourth diode having an anode coupled to the third output terminal and a cathode coupled to a fourth output terminal;

a first capacitor having a first terminal coupled to the cathode of the first diode and a second terminal coupled to the inverting electrode terminal;

a second capacitor having a first terminal coupled to the cathode of the second diode and a second terminal coupled to the electrode terminal;

a third capacitor having a first terminal coupled to the cathode of the third diode and a second terminal coupled to the inverting electrode terminal; and a fourth capacitor having a first terminal coupled to the cathode of the fourth diode and a second terminal coupled to the electrode terminal.

16. A drive circuit for an active liquid crystal display comprising:

a voltage generating circuit having a supply terminal for receiving a supply signal, and a plurality of output terminals, the voltage generating circuit generating voltage signals at its output terminals;

a drop signal generating circuit having a plurality of input terminals coupled to the output terminals of the voltage generating circuit to receive the voltage signals, and a plurality of output terminals, the drop signal generating circuit generating drop signals at its output terminals; and a signal mixing circuit having a plurality of source input terminals coupled to the output terminals of the voltage generating circuit to receive the voltage signals, a plurality of gate input terminals coupled to the output terminals of the drop signal generating circuit to receive the drop signals, and an output terminal, the signal mixing circuit generating a composite signal at its output terminal;

wherein the drop signal generating circuit further includes:

a control terminal for receiving a control signal;

a first diode having an anode coupled to a first input terminal and a cathode coupled to a first output terminal;

a second diode having an anode coupled to a second input terminal and a cathode coupled to a second output terminal;

a third diode having an anode coupled to a third input terminal and a cathode coupled to a third output terminal;

a first capacitor having a first terminal coupled to the cathode of the first diode and a second terminal coupled to the control terminal;

a second capacitor having a first terminal coupled to the cathode of the second diode and a second terminal coupled to the control terminal; and a third capacitor having a first terminal coupled to the cathode of the third diode and a second terminal coupled to the control terminal.

17. A drive circuit for an active liquid crystal display comprising:

a voltage generating circuit having a supply terminal for receiving a supply signal, and a plurality of output terminals, the voltage generating circuit generating voltage signals at its output terminals;

a drop signal generating circuit having a plurality of input terminals coupled to the output terminals of the voltage generating circuit to receive the voltage signals, and a plurality of output terminals, the drop signal generating circuit generating drop signals at its output terminals; and a signal mixing circuit having a plurality of source input terminals coupled to the output terminals of the voltage generating circuit to receive the voltage signals, a plurality of gate input terminals coupled to the output terminals of the drop signal generating circuit to receive the drop signals, and an output terminal, the signal mixing circuit generating a composite signal at its output terminal;

wherein the signal mixing circuit further includes:

a first transistor having a source coupled to a first source input terminal, a gate coupled to a first gate input terminal, and a drain coupled to the output terminal;

a second transistor having a source coupled to a second source input terminal, and a gate coupled to a second gate input terminal;

a third transistor having a source coupled to the second source input terminal, and a gate coupled to the second gate input terminal;

a fourth transistor having a source coupled to a third source input terminal, a gate coupled to a third gate input terminal, and a drain coupled to the output terminal;

a first diode having a cathode coupled to the drain of the second transistor and an anode coupled to the output terminal; and a second diode having an anode coupled to the drain of the third transistor and a cathode coupled to the output terminal.

* * * * *